US006561727B1

(12) United States Patent
Gustafson, Jr.

(10) Patent No.: US 6,561,727 B1
(45) Date of Patent: May 13, 2003

(54) ERGONOMIC HYBRID TRANSIT ACCESS CORRIDOR PARTICULARLY FOR TOWN AND URBAN CENTERS

(76) Inventor: Thomas F. Gustafson, Jr., 4901 N. Federal Hwy., Suite 440, Fort Lauderdale, FL (US) 33308

( * ) Notice: Subject to any disclaimer, the term of this patent is extended or adjusted under 35 U.S.C. 154(b) by 0 days.

(21) Appl. No.: 09/289,738

(22) Filed: Apr. 12, 1999

(51) Int. Cl.[7] ..... E01C 1/00
(52) U.S. Cl. ..... 404/1
(58) Field of Search ..... 404/1; 14/1, 3; 52/33, 174

(56) References Cited

U.S. PATENT DOCUMENTS

| | | | | | |
|---|---|---|---|---|---|
| 671,686 | A | * | 4/1901 | Bergeron | 404/1 |
| 1,628,934 | A | * | 5/1927 | Turner et al. | 404/1 |
| 3,272,097 | A | * | 9/1966 | Gazis et al. | 404/1 |
| 3,641,727 | A | * | 2/1972 | Hill | 52/174 |
| 3,847,496 | A | * | 11/1974 | Stankiewicz | 404/1 |
| 3,859,682 | A | * | 1/1975 | Sulkiewicz | 14/3 |
| 4,176,982 | A | * | 12/1979 | Boswell | 404/34 |
| 4,313,383 | A | * | 2/1982 | Parazader | 52/174 |
| 4,901,482 | A | * | 2/1990 | Lockard et al. | 52/174 |

OTHER PUBLICATIONS

Michael Southworth, "Walkalbe suburbs?" Information Access Company, Jan. 1997.*
Jennifer Berry, "Transit laws pull developers along a new path", Chicago Tribune Company, Jul. 4, 1993.*
Marlon Boarnet, "Transit–Oriented development in San Diego County" Information Access Co., Jan. 1, 1998.*
W.D. Middleton, "Baltimore LRT:" Railway Age, Oct. 1997.*
Stephen Daniels, "The Round at Beaverton Central", McGraw–Hill Companies, Oct. 1998.*
Stanley Allan, "A primer for station design; rail transit stations", Information Access Company, Mar. 1993.*
Chip Jacobs, "Lawmakers eye rail construction as a good planning opportunity", LA Bus. Journ., Dec. 2, 1991.*
Steve Kerch, "Once again, railroads become Chicago's engine of development". Chi. Tribune, Sep. 26, 1990.*
Ruth Knack, "BART's village vision" American Planning Association, Jan. 1995.*
Steve Kerch, "Beauty contest Parks, plazas abound at mixed–use projects", Chicago Tribune, Jul. 26, 1992.*
Brian Miller, "Planners hope to revitalize downtown Gresham", the Business Journal of Portland, Inc., Aug. 21, 1998.*

* cited by examiner

*Primary Examiner*—Thomas B. Will
*Assistant Examiner*—Raymond Addie
(74) *Attorney, Agent, or Firm*—M. K. Silverman

(57) ABSTRACT

An ergonomic hybrid transit access corridor, definable in terms of an x,y,z Cartesian coordinate system is characterized by x-axis integral, y-axis longitudinal segments each having an x-axis width in a range of about 3 to about 40 feet. The corridor includes a roadway, which may optionally include a roadway median. Symmetrically integrally outwardly about the roadway are respective parallel parking, bicycle lanes and greenscape segments, including a variety of selectable landscape and hardscape variables. Integrally symmetrically outwardly about the greenscape segments are respective greenway transit segments for selectable use by pedestrians and at pedestrian compatible speeds, said use including use by: (i) train-like vehicles, using small gauge rail tracks, having floors situated at a level not exceeding about 20 inches above the plane of the greenway transit segments, (ii) bicycles, and (iii) other pedestrian compatible vehicles. Integrally symmetrically outwardly from the greenway transit segments are respective second greenscape segments including a variety of selectable landscape and hardscape variables. Integrally symmetrically outwardly beyond the second greenscape segments are respective pedestrian arcade segments which define a yz plane interface between linear pedestrian rights-of-way, or easements, and private commercial store frontage defining the x-axis extent of the corridor.

14 Claims, 9 Drawing Sheets

ERGONOMIC HYBRID TRANSIT ACCESS CORRIDOR PARTICULARLY FOR TOWN AND URBAN CENTERS

BACKGROUND OF THE INVENTION

1. Field of the Invention

The instant invention relates to the area of civil engineering and, more particularly, to an improved transit system and method for access by pedestrians, bicyclists, transit users, motorists and, in some cases, equestrians, to improve urban mobility and ecology, this particularly in congested or moribund city and town centers, to thereby afford an experience of community within a transit environment connecting public and private transportation, community destinations, and commercial activities.

2. Description of Related Art

Efforts in the prior art to define pedestrian, bicycle and transit integrated urban and town center space have been burdened with an unfortunate developmental and planning history which, largely, has been a result of an emphasis during the twentieth century upon the automobile as the dominant mode of transportation. Thereby the development and fate of communities have been largely dictated by land and access remaining after all highway construction and reconstruction has been completed, with a resulting deterioration of the inner city and atrophication of commercial and cultural activity in the wake of the well-known suburban sprawl, wherein a wide variety of dispersed destinations and shopping malls have replaced city centers as the primary locus of employment, retail, social and cultural activity.

With the departure of business and, thereby, pedestrians and bicyclists from the historic inner city or, in the case of less urban areas, the town or village center, vestiges of the socially responsive lifestyle of the nineteenth and early twentieth century have largely disappeared. In others words, due principally to a lack of planning or design to integrate community transportation needs with other needs of the community, there has resulted an automobile and interstate highway network of roads which has impacted upon human values and social interactions across a broad range of community activities including, without limitation, housing, employment, education, and social or personal activities such as recreation, entertainment, shopping, restaurant, cultural, religious and governmental events or endeavors. As such, the dominance of the automobile, and its concomitant highway and super highway networks, has depleted inner cities and community centers not only of people, but also of architectural components, environmental qualities, urban adapted wildlife habitats, and open space large enough for a full array of social and personal events and activities associated with historic city centers, wherein most of the historic expression of society has occurred.

The present invention may, therefore, be understood in terms of a system and means through which traditional transit systems may be linked to all modes of transport utilizing an ergonomic hybrid transit access arrayed within a community to provide both commercial and social stimulus to city and community centers, by providing a visually diverse, and well landscaped, attractively built environment and open social space within the transportation corridor, and physiologically-defined parameters designed to create personal interest or "hold time," i.e., parameters designed to create for individuals within a system of such corridors, a personal interest in the space and people around them to thus encourage a pedestrian or bicyclist to want to continue in that mode of transport within an inventive "greenway" transit access corridor until the arrival of public transit, pursuant to an ergonomically defined schedule of service. As such, the present invention may be understood in terms of its purpose which is to provide improved pedestrian access to traditional rail and bus public transit systems for larger numbers of people over greater distances so as to counter, remedy and furnish alternatives to the automobile/interstate highway/shopping mall/sprawl development/destination dispersion lifestyle which has come to dominate contemporary life.

3. Prior Art

The prior art, as reflected in U.S. patents, discloses various types of transportation systems, some related to urban shopper traffic. For example, U.S. Pat. No. 3,405,612 (1968) to Pearson, entitled Method and Structure for Handling Urban Shopper Traffic, teaches a system in which all vehicles greater than passenger automobile height are barred from streets during shopping hours, and includes urban pedestrian bridges over streets.

U.S. Pat. No. 5,671,681 (1997) to Senior, entitled Transportation Method for Rider Propelled Vehicles, teaches the use of a covered bridge-like structure in which air moving therethrough provides aid to bicyclists riding in the direction of air flow within the structure.

In view of the above, the instant transit, access corridor may be viewed as a part of an evolutionary process of transportation intended to ameliorate the pedestrian, bicycle and transit adverse atmosphere found in many cities and suburban environments, while providing an improvement in the ecological, commercial, and social space characterizing city and community centers today.

SUMMARY OF THE INVENTION

The invention defines an ergonomic hybrid transit access corridor definable in terms of an x,y,z Cartesian coordinate system, in which such a corridor is characterized by a plurality of integral x-axis, y-axis corridor segments, the corridors having an aggregate x-axis width in a range of about 50 to about 230 feet, in which the entire corridor is characterized by between 12 and 17 longitudinal transversely narrow segments. Within an ergonomic hybrid transit access corridor there exists a plurality of corridor segments. In most instances, there is centrally disposed a vehicular bi-directional two to six lane roadway, including, in some instances, a roadway median to enhance bi-directional vehicular movements and street crossing safety and comfort. Each vehicular lane exhibits an x-axis width in a range of 9 to 12 feet. Reduction in lane width occurs or is imposed as a function of available space and a desired reduction in auto traffic speed to a rate of vehicular movement compatible, safe and comfortable for the nearby pedestrian and bicyclist or similar movements. Arranged symmetrically outwardly about said roadway are laterally disposed parallel parking segments and bicycle lane segments, and, thereafter, a greenscape segment usable for a variety of selectable landscape and hardscape variables. Symmetrically outwardly from said parallel parking segments, bicycle lane segments and greenscape segments are greenway transit segments for pedestrian and slow speed pedestrian compatible bicycle or similar movements, which include sets of small gauge rail tracks installed flush to or near the surface of the greenway transit segments, for use by a pedestrian compatible low speed, low profile pedestrian compatible tram, trolley or train-like transit vehicle having floors situated at an horizontal (xy plane) level not exceeding about 20 inches above the plane of the transit segments. Such segments are of sufficient width to facilitate co-use by pedestrians, bicycles, and these small transit vehicles and other pedestrian compatible vehicles or conveyances. Such segments connect to intermodel transportation linkages adjacent to the inventive corridor.

Beneath each greenway transit segment, a multi-purpose underground utility conduit may be constructed to serve as a foundation and also as a means of unified utility, information and service delivery and protection of utility conduits therein, these including without limitation: electric power cables; drinking water, re-use water and sewer lines; storm water drainage pipes; natural or synthetic gas lines; telephone, cable television and fiber optic communications; data transmission means; pneumatic tubes; security devices; fire services; a low current magnetic inductive track for vehicular propulsion; and storage, maintenance access, and transit power equipment for the multi-use subcorridors.

Further symmetrically outwardly therefrom, are respective second greenscape segments usable for a variety of selectable landscape and hardscape variables.

Outwardly beyond the second pair of greenscape segments are pedestrian arcade segments which comprise a yz plane interface between the public right of way or easement and private commercial store frontage which includes therein a variety of y-axis usages and attractions within such arcades or, alternatively, porches, awnings, balconies, roof overhangs, courtyards, zaquans or pedestrian vias. The number and length of each storefront is designed to provide frequent variety and pedestrian attractions to thereby direct pedestrian interest and attention to both the retail subject matter along the arcade and the landscape and streetscape details which lie ahead in the y-axis, thereby giving the pedestrian an incentive to move y-directionally forward until he has reached a physiologically and psychologically defined x-axis street or corridor intersection, or a defined sitting or park area within the corridor at which one may rest, congregate, and/or enter small, slow moving transit vehicles to travel further forward along the greenway transit segments to various known: intermodal facilities to access traditional rail and bus public transit; parking areas to access private automobile transport; or, local destinations significant for activities of daily life, i.e., destinations including home, work, schools, and social activities such as recreation, entertainment, shopping, cultural, religious, or government events or endeavors. The periodicity of the schedule of the small, slow moving transit vehicles and their routes within the greenway transit segments, adjacent to the arcade segments, are physiologically and psychologically defined so that a pedestrian will not abandon pedestrian, bicycle, transit or related transportation choices because one becomes impatient, bored, uncomfortable or weary, is too far from a desired destination or perceives it to be too far from a destination to comfortably walk, bicycle, or use transit to get there.

The arcade store frontage, as well as the roof, balcony, porch or awning overhang thereof comprise aspects of larger z-axis architectural structures which selectably include retail uses on the first floor fronting the corridors, multi-level parking and non-retail commercial and residential usages at upper levels thereof. The arcade-characterized geometry of such z-axis structures may be effected through retrofit treatments of pre-existing structures.

A greenway ratio of the instant corridor is defined by a relationship of a combined dimension of the x-axis of the roadway, the roadway median (if any) and parallel parking segments, to the entire x-axis of the corridor, that is not greater than about fifty percent. The z-axis or height of the above-referenced architectural structures is typically constructed when buildings exist on one or both sides of the corridor, so as to provide an enclosure ratio that will range from about thirty to about fifty percent of the x-axis dimension of the corridor. Where this enclosure ratio is not met other means to provide enclosure protection and design interest within a defined cross-section of the transit greenway network can be designed, including, without limitation: additional landscape or open space to retain pedestrian and bicyclist comfort; transit connections to pass through any enclosure gap; and village squares positioned within optimal distances of 900 to 1500 feet of each other.

Further, architectural lighting is provided for the corridor, including transit vehicles, to provide appropriate effects and safety at night. More generally, architectural lighting is selectably used as a design, theme or activity-enhancing medium.

It is therefore an object of the invention to provide a pedestrian-oriented transportation system to improve the quality of life in urban, suburban and environmentally-sensitive settings, enabling improved intermodel connection of traditional rail and bus public transit to community destinations, using corridors of sufficient width to provide multiple walkways and corridors for pedestrians and bicyclists, and greenway transit corridors for pedestrians, bicyclists and small, slow moving, pedestrian compatible, transit vehicles for movement beyond the distance of a comfortable walk or bike ride and, where community interest exists, corridor widths for equestrian movements.

Another object is to provide a transit system for the linking together of residential neighborhoods, places of employment, schools, recreations areas, entertainment and shopping destinations, restaurants, cultural, religion, social and governmental facilities, with interconnection to traditional rail and public transportation, airports and seaports to thereby relieve congestion caused by automobiles and trucks, and enhance ecological factors for the community.

A further object of the invention is to provide an improved transit system having social, economic and commercial benefits to communities using such a system.

It is a yet further object to provide socially interactive, physically comfortable corridors within view or easy access to residences, places of employment, schools, and social or personal activities such as recreation, entertainment, shopping destinations, restaurants, and cultural, religious, or governmental events or other endeavors.

The above and yet other objects and advantages of the present invention will become apparent from the hereinafter set forth Brief Description of the Drawings and Detailed Description of the Invention.

DETAILED DESCRIPTION OF THE INVENTION

Figure 1:
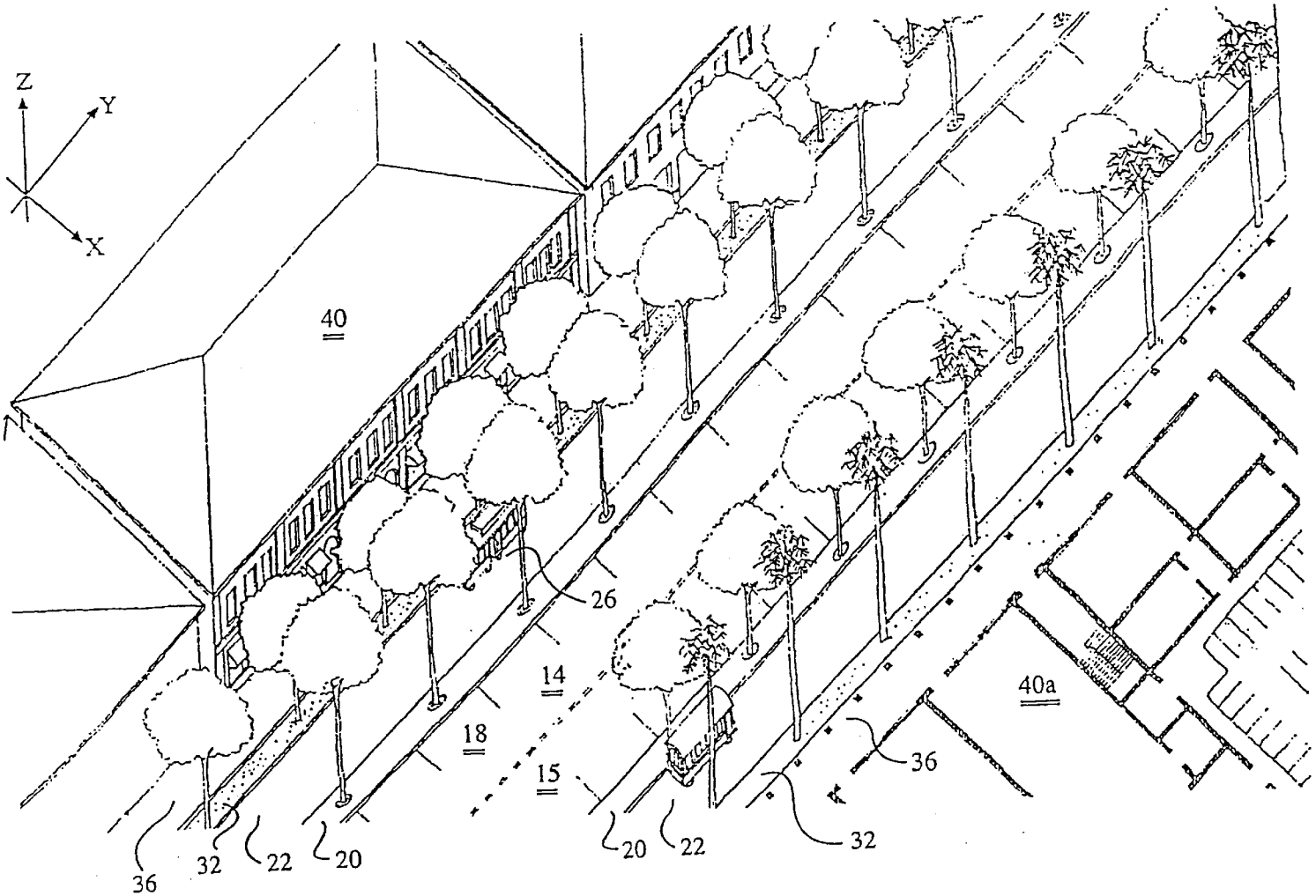
FIG. 1 is a perspective view of a two lane bi-directional roadway embodiment of the inventive ergonomic hybrid transit access corridor, i.e., pedestrian, bicycle, transit and, where appropriate, equestrian, showing thereon the xyz coordinate axes thereon.

With reference to the views of FIGS. 1 to 5, the instant ergonomic hybrid transit access corridor may 10 or 100 be seen to include a plurality of x-axis integral, y-axis corridor segments. Therein, as may be noted, each corridor segment is characterized by a longitudinal or y-axis of indefinite length, however limited by x-axis intersections 12 (see FIG. 5), more fully addressed below. It may, with reference to FIGS. 1 through 5, be appreciated that the instant ergonomic hybrid transit access corridor is characterized by a preferably centrally disposed bidirectional roadway consisting of lanes 14 and 15, each having a width preferably of 9 to 12 feet, which may be preferably separated by a roadway median 16 having a width of about 5 to about 20 feet. See embodiment of FIG. 3. Provided outwardly of lanes 14 and 15 are parallel parking segments 18, each having a width preferably of 8 to 9 feet. However, in the elaborated embodiment of FIG. 3, bicycle lane segments 19, each having a width preferably of 4 to 5 feet, are provided between roadway lanes 14*a*/15*a* and said parallel parking segments 18. In the rudimentary embodiment of FIGS. 1–2, bicycle lane segments may be integrated or separately arranged from first greenscape segments 20 described below.

Situated yet further symmetrically outwardly from parking segments 18 are said greenscape segments 20, having a width preferably of 3 to 6 feet or more when other segments or other corridor features are incorporated therein, which may include any of a variety of landscape and hardscape treatments and which can be used to laterally move from one corridor segment to another. Outwardly thereof are greenway transit segments 22, having a width preferably of 15 to 40 feet, which generally include small-gauge rail tracks 24 (see FIG. 2A), that is, tracks having an x-axis width in a range of 24 to 30 inches and thereupon, a low speed, e.g., 5 to 10 miles per hour, low profile preferably electric, battery powered, tram, trolley, train or like transit vehicle 26 having a floor 28 (in the horizontal xy plane) situated at a level not exceeding about 20 inches above the plane of the greenway transit segments 22. It is to be appreciated that each of the greenway transit segments 22 are multi-use in character, that is, functional for purposes of pedestrian and low speed bicycle or similar conveyance use both during periods when the small transit vehicles 26 are not present and, at lateral sides of the small-gauge rail tracks 34, when such transit vehicles 26 are upon the rail component of the greenway transit segment 22. Optionally disposed beneath each greenway transit segment 22 is a multi-purpose utility conduit 30 (see FIGS. 2 and 7) which serves as a means of unified utility delivery. As such, conduit 30 includes subconduits for electricity; drinking water, re-use water, sewer lines and storm water drainage; natural or synthetic gas; telephone, cable television, fiber optics, and other communication and data transmission means; pneumatic tubes; security services; fire services; and low current magnetic induction tracks for vehicular propulsion. In addition, utility conduit 30 may be employed for storage, maintenance access, or transit power equipment for the greenway transit segments 22.

Figure 2:
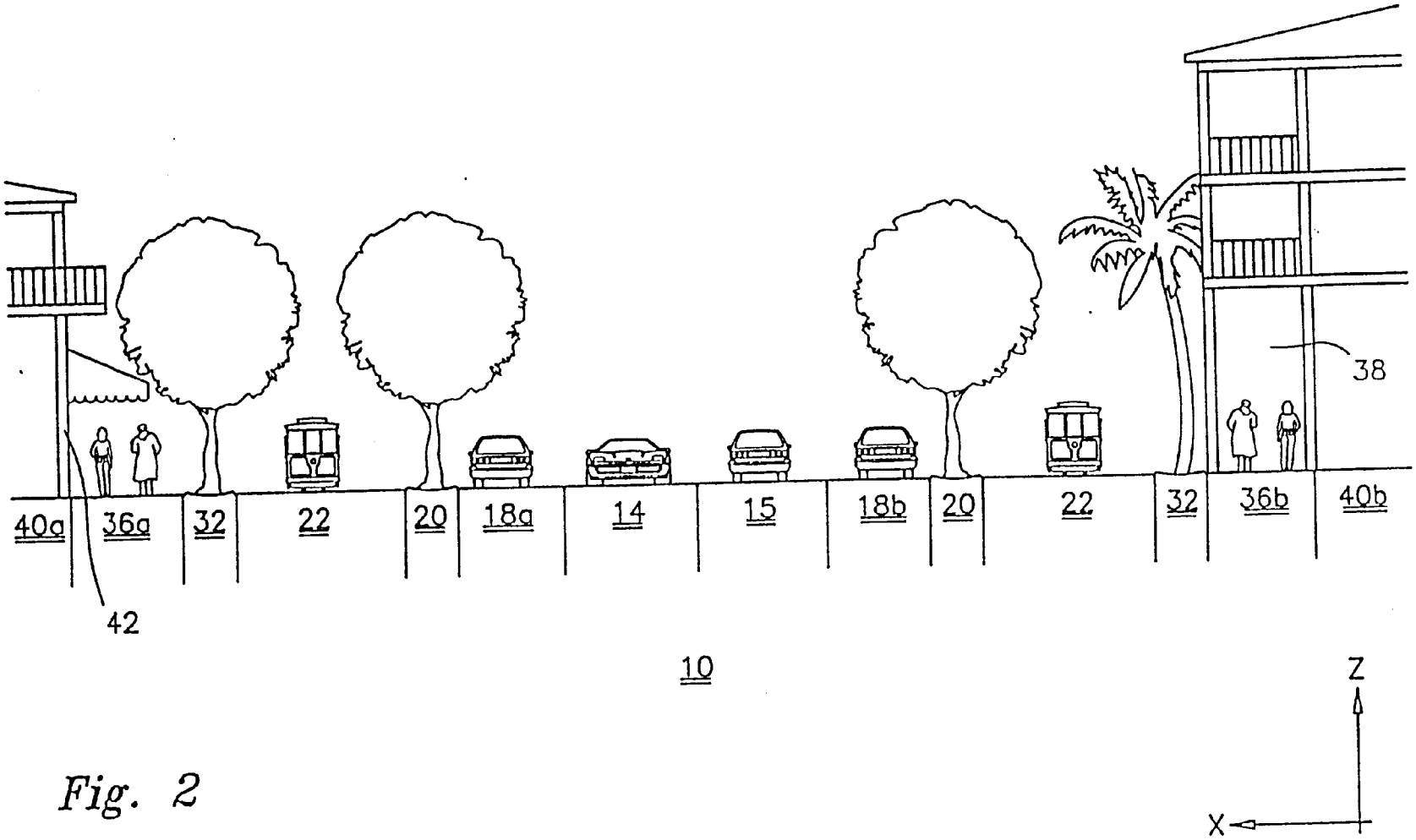
FIG. 2 is a sketch showing the appearance of the corridor of FIG. 1 in cross-sectional view taken through the xz plane.
Figure 2A:
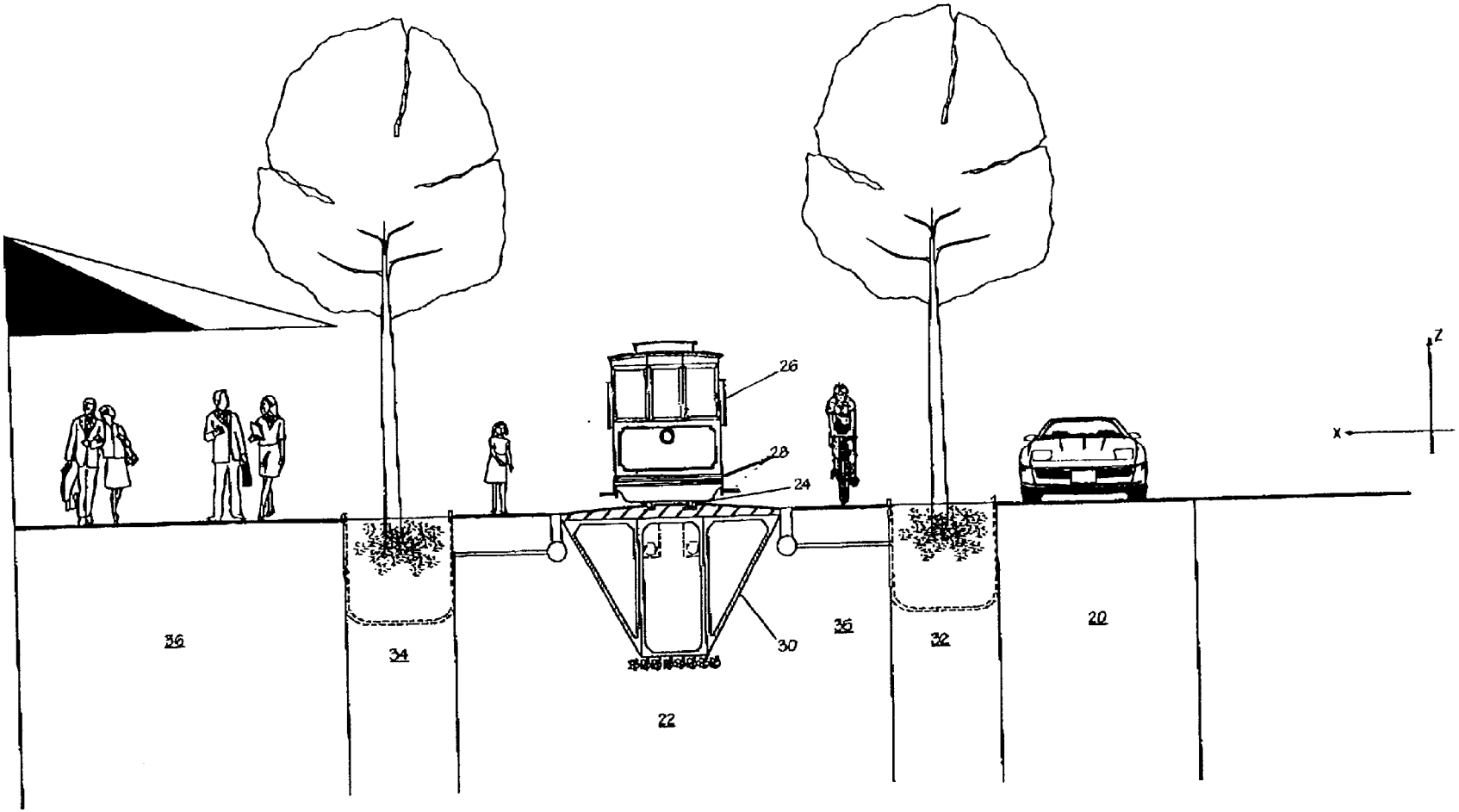
FIG. 2A is an enlarged underground cross-sectional view of a greenway transit segment and multi-purpose utility conduit of FIG. 2.

With further reference to FIGS. 1 to 2, there are located, further symmetrically outwardly from the greenway transit segment 22, second greenspace segments 32 which, as in the case with first greenspace segments 20, may include a variety of landscape and hardscape treatments and which can be used to laterally move from one corridor segment to another. Each of the greenspace segments 20 and 34 provide filtered sunlight and shade tree coverage for an optimum foliage spread of such segments and adjoined areas, as well as opportunities to install fountains and other artistic or architectural features to provide comfort and interest to the individuals traveling within the corridor segments.

Figure 3:
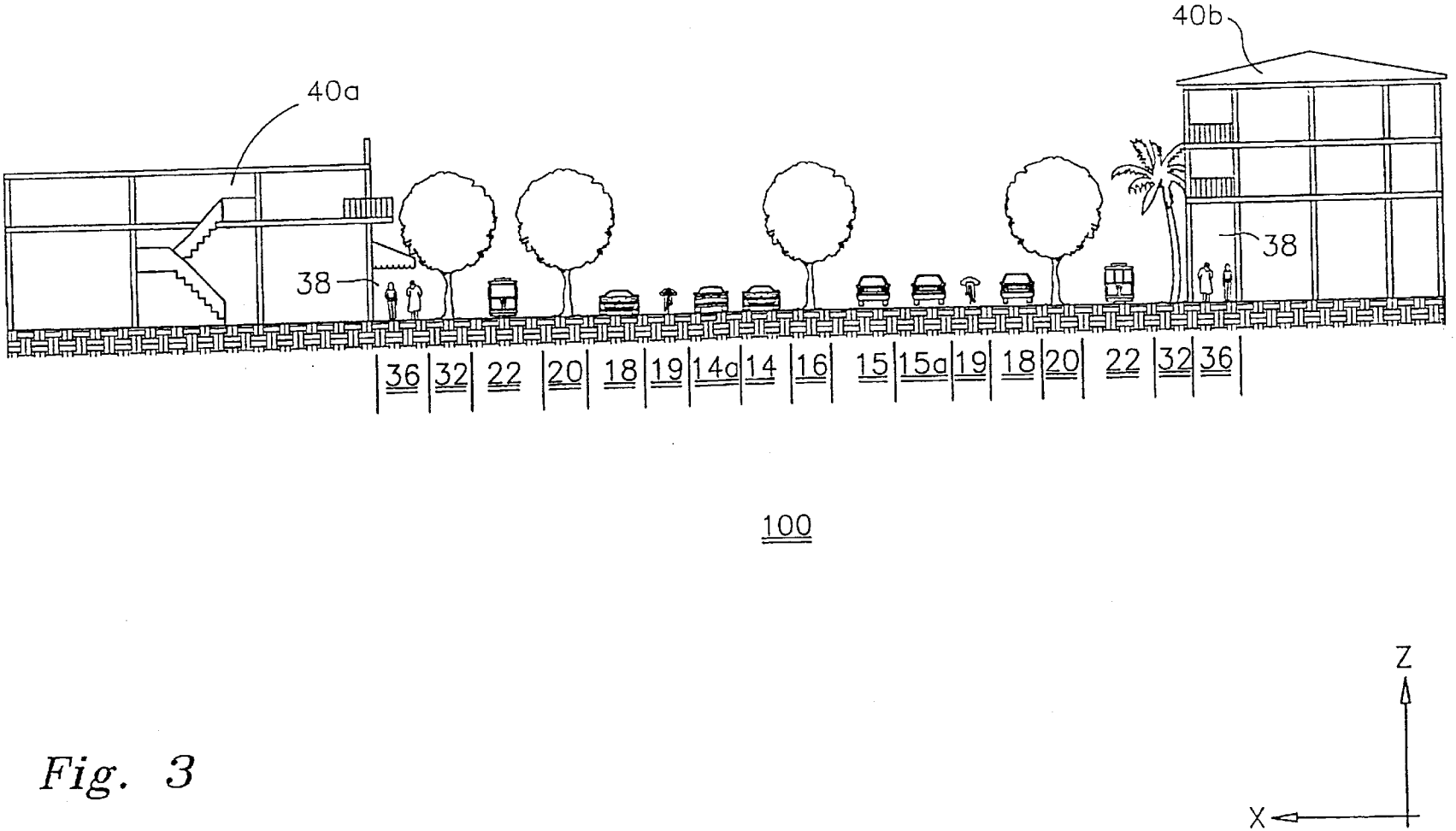
FIG. 3 is a cross-sectional taken through the xz plane of a four lane roadway embodiment of the corridor.

Symmetrically outwardly beyond lateral segments 32 are pedestrian arcade-like segments 36 having a width preferably in a range of 10 to 15 feet. The preferred xz plane cross-section of arcades 38 within segments 36 is shown in FIGS. 2, 3 and 6. Therein it may be appreciated that, in a preferred embodiment, arcade 38 of segment 36 is, in the xz plane, enclosed on two or three sides by architectural structures 40 and 40*a* which, at surface 42, provides for commercial stores and fronts thereof which may include therein a variety of y-axis uses and attractions. The number and length of the store fronts or architectural details of surface 42 are designed to protect the pedestrian from the rain, wind, heat and cold, and to optimize pedestrian spacing and interest to urge the pedestrian to move continually forward along the y-axis toward a destination or transit linkage 12. (See FIG. 5). A maximum distance for such pedestrian movements are defined in accordance with established psychological and medical criteria of how far a pedestrian can comfortably walk, in the given climate where the greenway transit system is located, before beginning to loose interest, perspire or tire, given the typical mental and physiological characteristics of individuals moving through the corridor segment. Related to the time that it would typically take a consumer to walk along a pedestrian arcade segment 36 between destinations or transit use opportunities 12 is the periodicity of the schedule of small transit and traditional rail and bus public transit vehicles 26 and the variety of end uses or refinements of the architectural design details. Accordingly, the schedule of the transit vehicles 26 as well as the land use itself and architectural design variations are a function of typical physiologic and psychological considerations.

It is noted that arcade 38 may be defined through the use of arcades, balconies, porches, awnings, roof overhangs, zaquans, pedestrian vias, and other pedestrian and bicycle related shelters. That is, with further reference to FIG. 6, it is noted that surface 44 defines an xz plane interface between the public right of way and private architectural structures such as structure 40. These structures may be retrofitted to provide for arcade 38 or, alternatively, lobbies, courtyards, zaquans, or pedestrian vias.

It is to be appreciated that within greenway transit segment 22 and greenspace segments 20, 32 may be seen bicycle lanes 19 or walking trails. Also, all aspects of the corridor are provided with strategic architectural lighting for purposes of safety and aesthetics.

Figure 4:
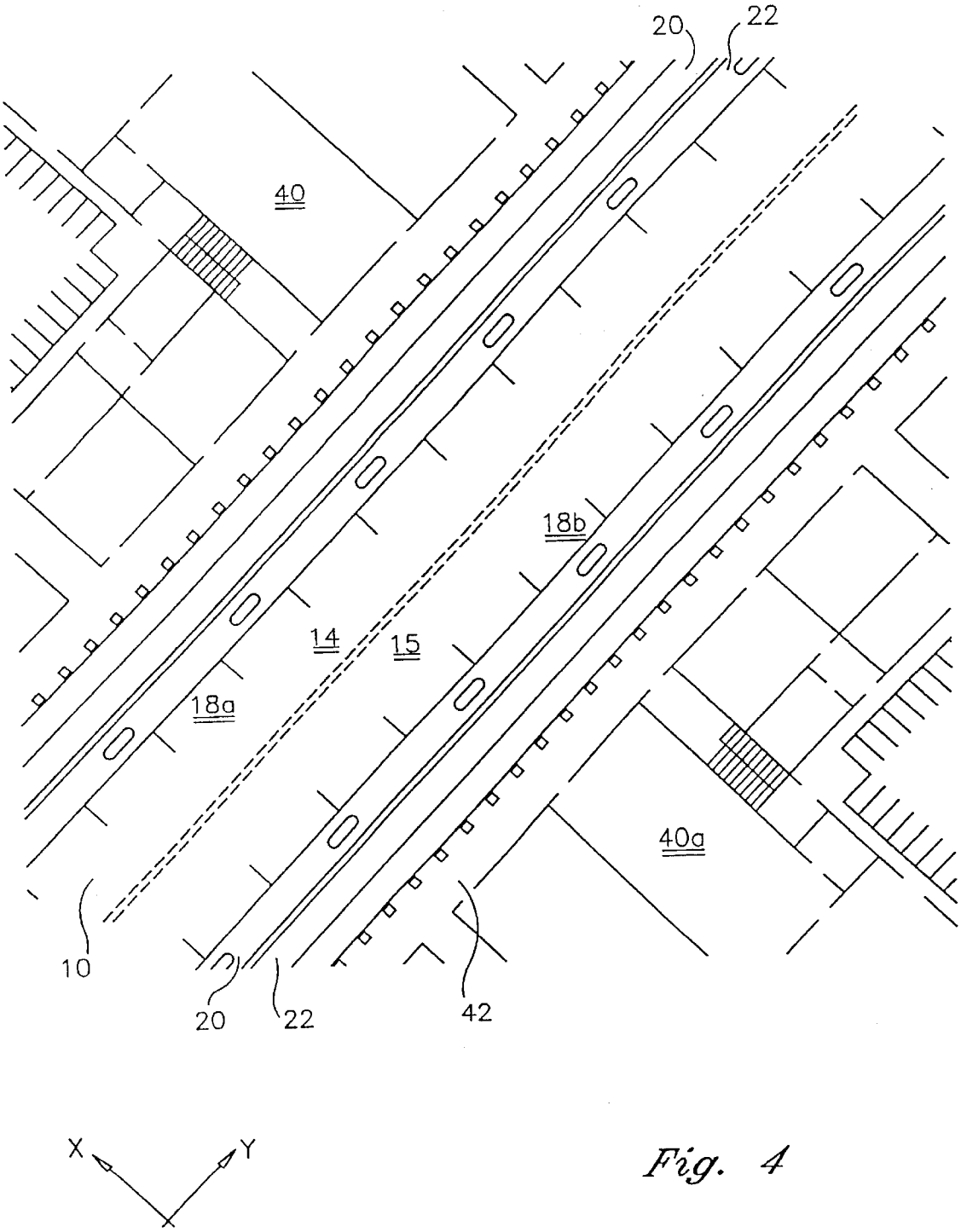
FIG. 4 is a top schematic view of the corridor of FIG. 1 showing the appearance thereof in the xy plane.
Figure 5:
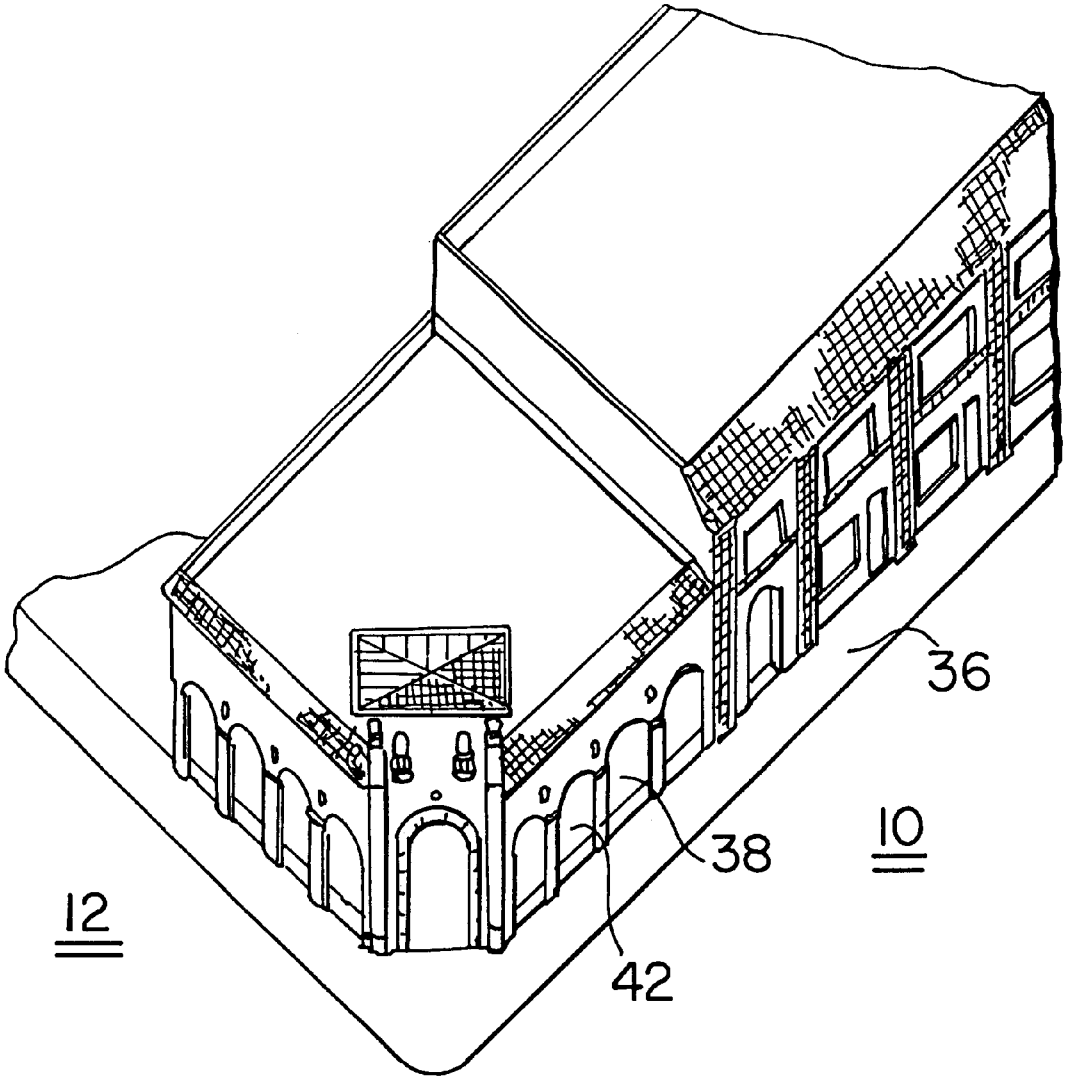
FIG. 5 is a schematic view showing the appearance of a pedestrian arcade segment at a street intersection.
Figure 5:
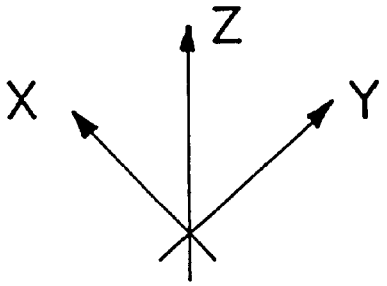

With reference to the top or xy plane view of FIG. 4, the lateral relationship between all of the above defined integral corridor segments 10 may be seen. Therein, as may be appreciated, are shown said greenway and enclosure ratios, which comprise two of the defining parameters of the present system. More particularly, the greenway ratio is defined as the ratio of the x-axis dimension of roadway 14/15, any roadway median, and parallel parking segments to the entire x-axis dimension of the corridors 10 or 100 (see FIG. 3). This ratio, in the instant system, exhibits dimensions that will not exceed fifty percent. The enclosure ratio is defined as the ratio of the z-axis of height of the architectural structures to the entire x-axis dimension of the corridor. This ratio in the instant system, at optimal dimensions, is at least thirty to about fifty percent. For example, if the width of each vehicular lane is 10 feet and the two lane roadway is therefore a width of 20 feet, the total x-axis dimension of the corridor will be at least 40 feet. With two 8-foot wide segments for parallel parking, the width of the corridor 10 or 100 would be 72 feet or greater. In such an example, the z-axis height of the architectural structures would range from at least 24 feet to about 36 feet.

A four lane roadway (see FIG. 3), the inclusion of parallel parking segments would produce a width of the corridor 10 or 100 of 112 feet or more with a 15 foot roadway median between each two lane roadway sections, the width of the corridor 10 or 100 would be 142 feet or more. The z-axis height of architectural structures 40 and 40*a* would range from about 37 feet to 56 feet in the first instance and about 47 feet to 71 feet in the second instance. Even at a maximum highway lane width of 12 feet, the overall width of the corridor would typically be at least two times the width of the roadway, the roadway median and the parallel parking segment.

It is noted that said corridors 10 and 100 may comprise segments of larger linear, bi-directional, uni-directional, or loop-like planning configurations.

Figure 6A:
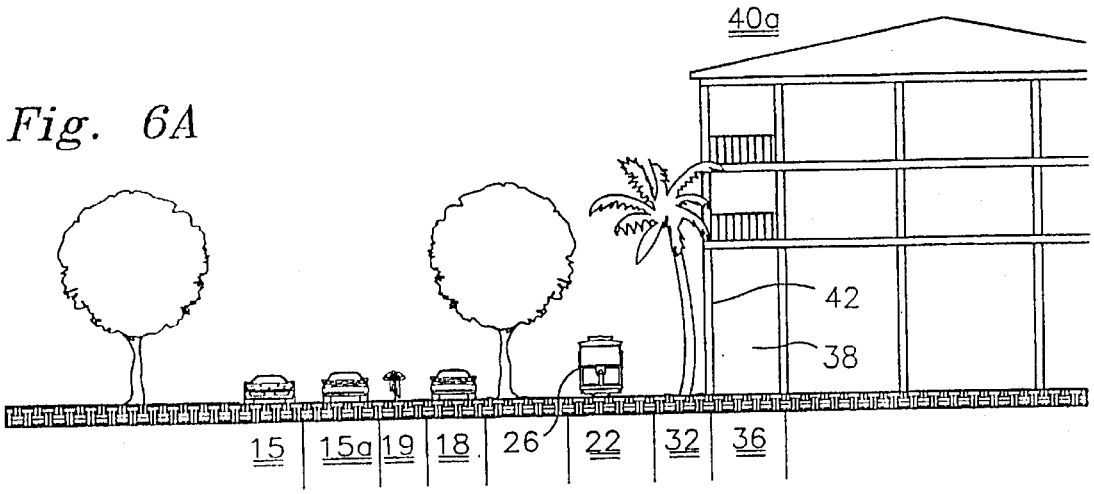
FIGS. 6A and 6B are sketches showing the appearance of the corridor of FIG. 3 with the use of different types of pedestrian arcade segments.
Figure 6B:
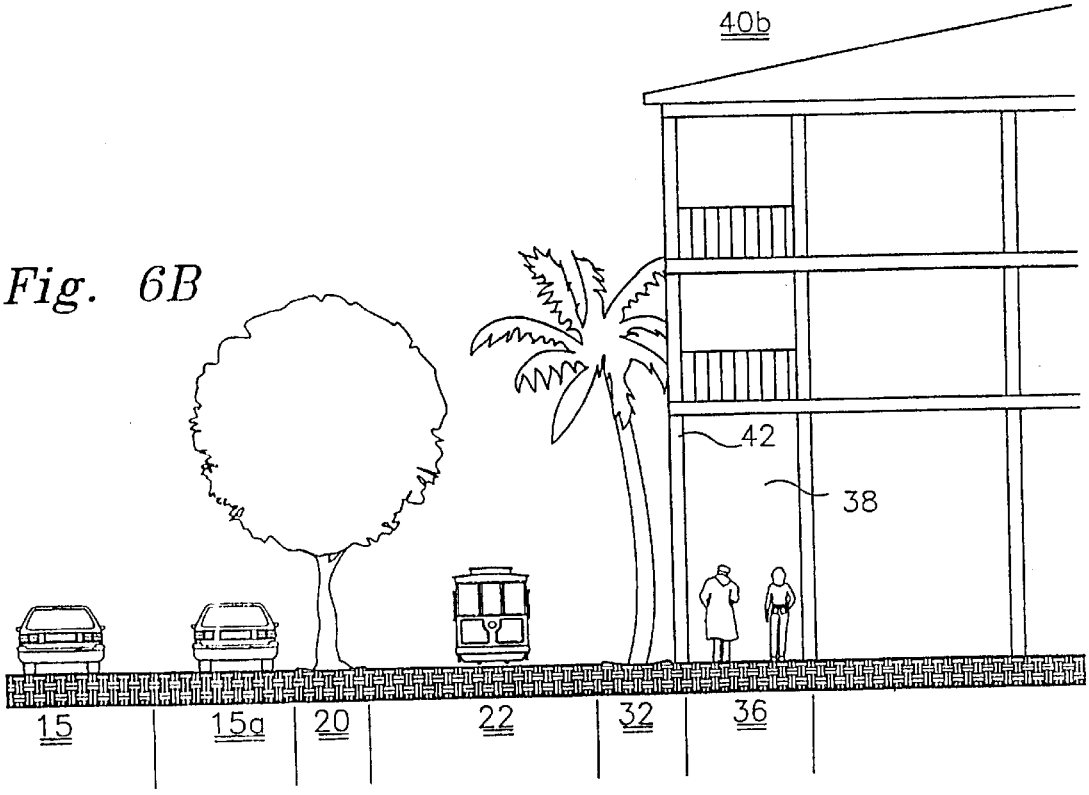

Shown in FIGS. 6A and 6B are architectural options, within structures 40 and 40*a,* which may be used to define an arcade or to cover a stop of the small transit vehicle 26. See also FIGS. 2 and 2A.

Figure 7:
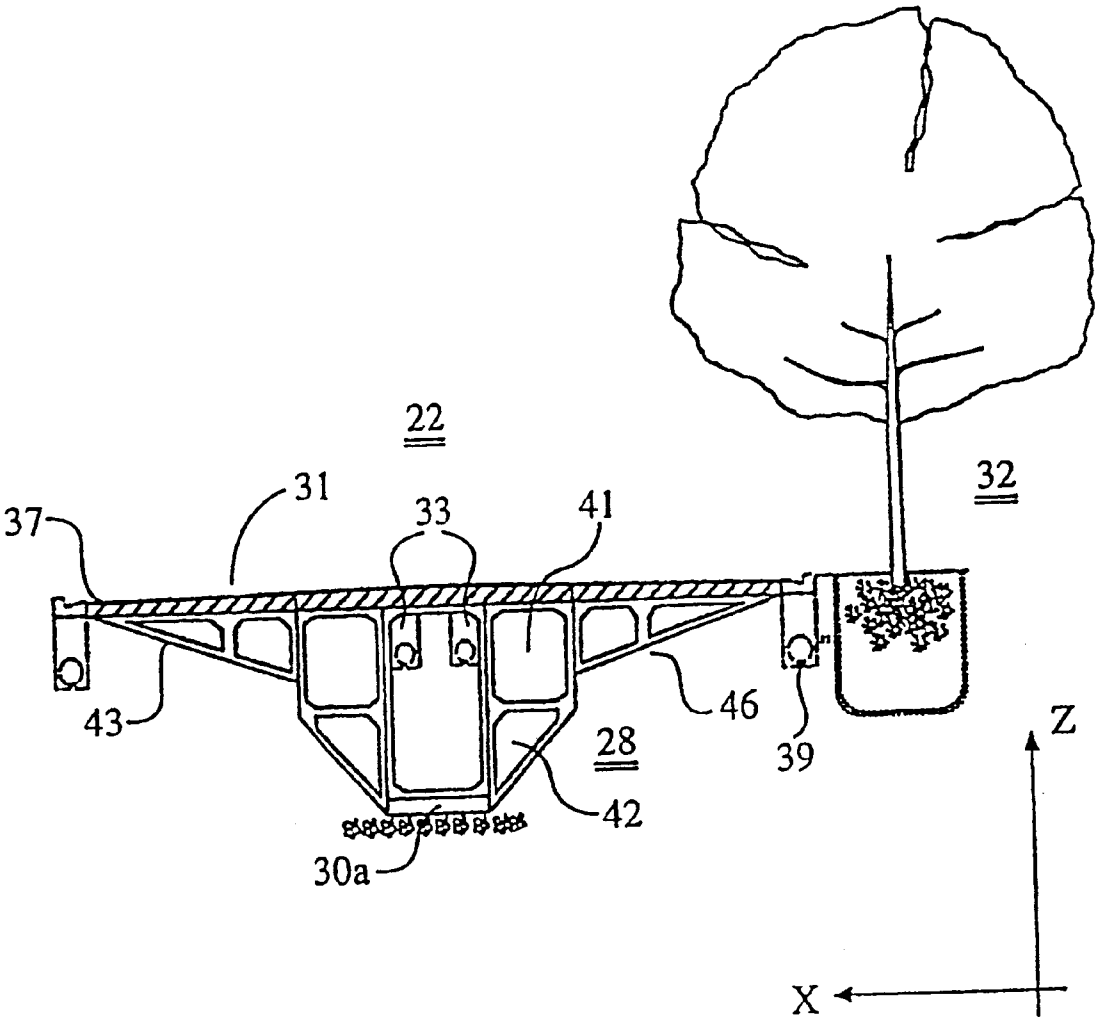
FIG. 7 is an enlarged cross-sectional view of a variation of the greenway transit segment and utility conduit shown in FIG. 2A.

With reference to FIG. 7, there is shown an alternate embodiment of conduit 30, namely, a multi-purpose utility conduit 30*a* which includes a pre-manufactured composite roadway 31 capable of supporting pedestrians, bicycles, small transit vehicles, small maintenance vehicles or similar conveyances on the greenway transit segment. Near the center of conduit 30a are locations 33 for potential water main installations and curbs 37. Beneath curbs 37 are drainage modules 39. The x-axis width of the conduit is preferably in a range of 15 to 40 feet, with an 8 inch or greater surface depth and a positive x-axis two percent grade from the yz plane center to the x-axis lateral ends thereof. The z-axis depth of the conduit 30*a* is about 6 feet. Many service ducts 41 and 42 are provided within the conduit for utilities including electricity; drinking water, re-use water, sewer lines and storm water drainage; natural or synthetic gas; telephone, cable television, fiber optics, and other communication and data transmission means; pneumatic tubes; security services; fire services; low current magnetic induction tracks for vehicular propulsion; and storage, maintenance access or transit power equipment for the greenway transit subcorridors 22. Lateral arms 43 and 46 of the conduit 30*a* may be detached therefrom.

Figure 8C:
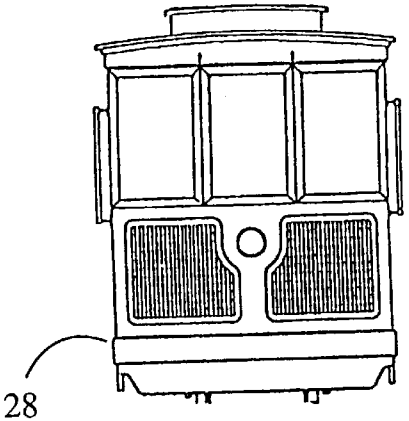
FIGS. 8A to 8C are views of a transit vehicle of a type used within the greenway transit segments of the invention.
Figure 8A:
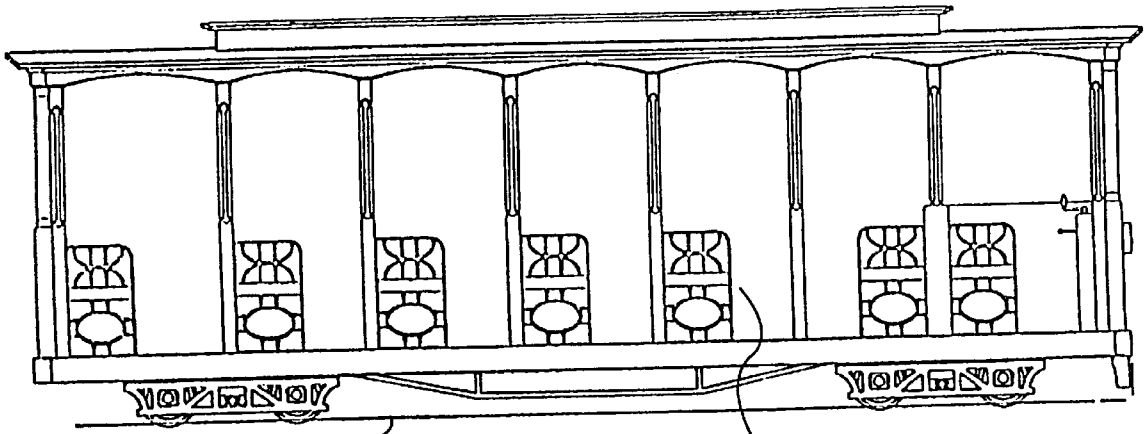
Figure 8B:
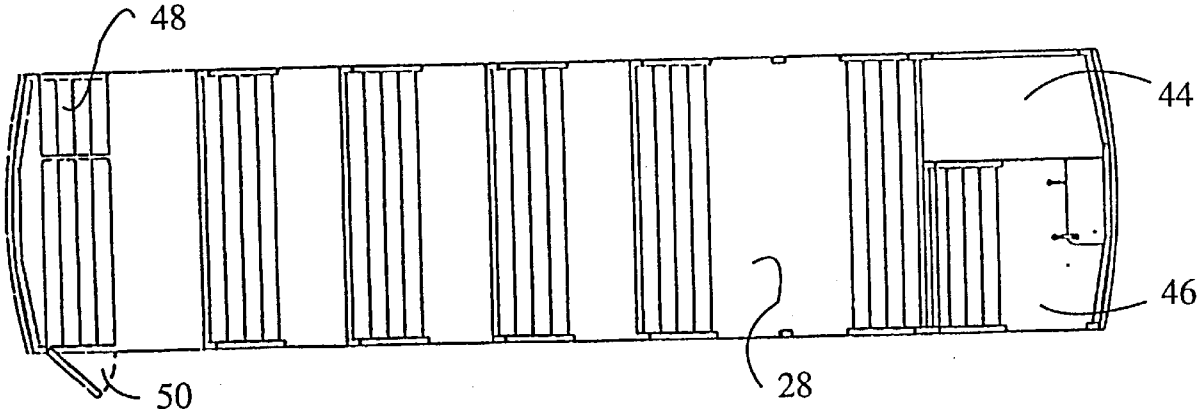

In FIGS. 8A to 8C are shown an example of a train or tram 26 that could operate upon the small gauge tracks 24. Such a train may have a length in a range of 15 to 30 feet per car, a height of about 6 to about 9.5 feet, and a width of about 4 to about 7 feet. FIG. 8B shows the interior of the vehicle in horizontal cross-sectional view. The floor 28 thereof is typically located about 20 inches or less above tracks 24. FIG. 8B also shows engine compartment 44, operator compartment 46, flip-up seats 48, and wheel chair access 50.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

Having thus described my invention what I claim as new, useful and non-obvious and, accordingly, secure by Letters Patent of the United States is:

1. An ergonomic hybrid transit access corridor, particularly for town and urban centers, definable in terms of an x, y, z Cartesian coordinate system, in which said corridor is characterized by a plurality of x-axis contiguous, y-axis longitudinal, segments each having an x-axis width in a range of about three to about forty feet, the corridor comprising:

(a) a vehicular roadway;

(b) contiguously, symmetrically, outwardly of said roadway, respective parking segments;

(c) contiguously, symmetrically, outwardly about said parking segments, respective first greenscape segments including selectable landscape and hardscape variables;

(d) contiguously, symmetrically, outwardly about said first greenscape segments, respective greenway transit segments for selectable use by pedestrians and vehicles operating at pedestrian-interactive speeds;

(e) contiguously, symmetrically, outwardly from said transit segments, respective second greenscape segments including therein selectable landscape and hardscape variables;

(f) contiguously, symmetrically, outwardly beyond said second greenscape segments, respective pedestrian arcade segments that are at least partially covered, said segments having a width of between about 10 and about 15 feet, said segments defining a substantially continuous yz plane interface between linear pedestrian rights-of-way or easements, and substantially contiguous private commercial store frontage at ground level, thereby defining the outermost x-axis extent of said corridor;

(g) an enclosure ratio, of the z-axis height dimension of said continuous yz plane interface of said corridor, to the entire x-axis dimension of all segments of said corridor, that does not exceed a range of about thirty to about fifty percent at any point of said yz plane interface; and (h) a greenway ratio of combined x-axis dimensions of said vehicular roadway and said parking segments, to said entire x-axis of said corridor that does not exceed about fifty percent.

2. The corridor as recited in claim 1 in which lanes of said roadway each comprise a width of between about nine and twelve feet, each of said parking segments comprise a width of between about eight and about nine feet, and each of said greenway transit segments comprise a width of between about fifteen and about forty feet.

3. The corridor as recited in claim 1, comprising bicycle trails integrated within one of more or said greenscape segments.

4. The corridor as recited in claim 1, in which said roadway comprises a bi-directional roadway.

5. The corridor as recited in claim 4, further including:

a greenspace roadway median having an x-axis width in the range of between about 5 and 20 feet, disposed between opposing lanes of said bi-directional roadway.

6. The corridor as recited in claim 5, in which said vehicular bi-directional roadway comprises between one and three lanes in each direction.

7. The corridor as recited in claim 1; further comprising:

symmetrically contiguously outwardly of said roadway but preceding said first greenscape segments, respective parallel parking segments.

8. The corridor as recited in claim 5, further comprising:

dedicated bicycle lane segments disposed integrally between an outermost lane of said roadway and said parallel parking segments.

9. The corridor as recited in claim 5, in which said arcade segments are defined by architectural treatments selected from the group consisting of roofs, archways, balconies, porches, awnings, lobbies, courtyards, zaquans, and pedestrian vias.

10. The corridor as recited in claim 5, further comprising:

underground and beneath at least one of said greenway transit segments, a multi-purpose underground utility conduit system, an upper xy surface comprising a greenway transit segment foundation and an interior structure comprising utility subconduits.

11. The corridor as recited in claim 10 in which said subconduits comprise means for holding or supporting one or more of electric cables; drinking water, re-use water, sewer lines, storm water and drainage means; lines for natural or synthetic gas; telephone, cable television, fiber optic and other communications and data transmission channels.

12. The corridor as recited in claim 10 in which said subconduits comprise:

means for storage of maintenance or transit power equipment.

13. The corridor as recited in claim 10 in which said subconduits further comprise:

a low current magnetic inductive track for vehicular propulsion.

14. The corridor as recited in claim 1 comprising about 12 to about 17 of y-axis longitudinal segments.

* * * * *